US007802933B2

(12) United States Patent
Lysiak et al.

(10) Patent No.: US 7,802,933 B2
(45) Date of Patent: Sep. 28, 2010

(54) THERMAL PRINTER CARTRIDGE WITH ENERGY ABSORBING FEATURES

(75) Inventors: Paul A. Lysiak, Rochester, NY (US); Kevin H. Blakely, Rochester, NY (US); Joel S. Lawther, East Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 781 days.

(21) Appl. No.: 11/318,281

(22) Filed: Dec. 23, 2005

(65) Prior Publication Data

US 2007/0147931 A1 Jun. 28, 2007

(51) Int. Cl.
*B41J 35/28* (2006.01)

(52) U.S. Cl. ..... 400/208; 400/207; 400/208.1; 347/214

(58) Field of Classification Search ..... 400/208, 400/207, 208.1; 347/214, 215, 217
See application file for complete search history.

(56) References Cited

U.S. PATENT DOCUMENTS 4,978,240 A * 12/1990 Katsuno ..... 400/224.2
5,455,617 A 10/1995 Stephenson et al.
5,620,265 A * 4/1997 Kondo ..... 400/196
6,522,349 B1 2/2003 Lee
7,522,179 B2 * 4/2009 Lysiak et al. ..... 347/214

FOREIGN PATENT DOCUMENTS

EP 0 515 224 11/1992
EP 0 878 314 11/1998

* cited by examiner

*Primary Examiner*—Ren Yan
*Assistant Examiner*—Matthew G Marini
(74) *Attorney, Agent, or Firm*—Roland R. Schindler, II; David A. Novais

(57) ABSTRACT

A thermal printer cartridge is provided. The thermal printer cartridge comprising: a supply housing having a drive end and a non-drive end; a take-up housing having a drive end and a non-drive end; a stiffening linkage joining the non-drive end of the supply housing to the non-drive end of the take-up housing, the stiffening linkage being capable of elastic deflection to absorb a portion of the energy from an impact load; an elastically deformable linkage joining the drive ends, the resilient linkage being adapted to elastically deflect following a first deflection pattern and to absorb another portion of an amount of energy from a impact load; and a damping linkage joining the drive ends, the damping linkage being adapted to elastically deflect following a second deflection pattern that is different than the first deflection pattern and to absorb still another portion of an amount of energy from the impact load.

4 Claims, 4 Drawing Sheets

THERMAL PRINTER CARTRIDGE WITH ENERGY ABSORBING FEATURES

FIELD OF THE INVENTION

The invention relates to thermal printer cartridges.

BACKGROUND OF THE INVENTION

A thermal printer prints images by transferring donor material from a donor ribbon onto a receiver medium. Typically this is done by selectively heating the donor ribbon to melt donor material while concurrently pressuring the donor ribbon against the receiver medium. In this way, melted donor material transfers from the donor ribbon to the receiver medium to form an image while unmelted donor material remains on the donor ribbon. Donor ribbon is typically connected between a supply spool, which initially carries a supply unused donor ribbon, and a take-up spool upon which used donor ribbon is wound. In operation, the take-up spool is rotated to draw donor ribbon from the supply spool and across the print head for use in printing.

The donor spool and take-up spool can be provided as independent rolls joined only by the donor web. Alternatively, the donor spool and take-up spool can be joined together by a structural framework to form a thermal donor cartridge. Such a thermal donor cartridge provides a rigid structure around the supply spool and the take-up spool that can be used to protect the donor ribbon from incidental contact and from contaminants and that also positions the supply spool and the take-up spool in a geometric relationship. A wide variety of thermal printer cartridge designs are known. Typically each thermal printer cartridge is designed to be used in one particular type of thermal printer.

As thermal printing has grown in popularity, particularly in consumer applications, there has been a demand for thermal printer cartridges that can hold larger amounts of donor ribbon. However, the design of such high quantity thermal printer cartridges creates unique design problems. One of the most difficult problems is the challenge of creating a low cost and high quality cartridge which can survive the sometimes torturous environment that a typical consumer will subject it to. This is because the relatively large supply of thermal donor ribbon in such a thermal donor cartridge increases the weight of the thermal donor cartridge, which in turn, substantially increases the kinetic energy that the cartridge must be able to dissipate during a fall or drop or other impact incident.

In particular, it will be appreciated that when the donor cartridge is subjected to an impact load, a substantial shock wave permeates the donor cartridge. The energy from such a shock wave must be managed by the structures of the thermal printer cartridge in a way that allows the energy from an impact to be dissipated without non-elastic deformation of the thermal printer cartridge that could interfere with the use of a dropped thermal cartridge.

Accordingly, the design of a high load thermal printer cartridge is typically adapted to address this issue. One way in which this can be addressed is to provide a more rigid thermal donor cartridge which can be done by using materials such as metals or expensive, high modulus of elasticity materials to form the thermal donor cartridge or to form the thermal donor cartridge using large, heavy, stiff structural forms. Alternatively, energy absorbing features can be incorporated into the exterior of the donor cartridge such as by applying cushioning bumpers to the thermal donor cartridge. These methods however, increase the size, weight and cost of the thermal printer cartridge.

What is needed is a low cost thermal printer cartridge that is adapted to manage relatively high kinetic energy loads.

SUMMARY OF THE INVENTION

In one aspect of the invention, a thermal printer cartridge is provided. The thermal printer cartridge comprises: a supply housing having a drive end and a non-drive end; a take-up housing having a drive end and a non-drive end; a stiffening linkage joining the non-drive end of the supply housing to the non-drive end of the take-up housing to define a separation between them, the stiffening linkage being capable of elastic deformation to absorb a portion of an energy from an impact load; an elastically deformable linkage joining the drive ends, the elastically deformable linkage being adapted to elastically deflect following a first pattern and to absorb another portion of the energy from the impact load during the deflection. A damping linkage joins the drive ends, the damping linkage being adapted to elastically deform following a second deflection pattern that is different than the first deflection pattern and to absorb still another portion of the amount of energy from the impact load during such deformation, the damping linkage further being adapted to damp deflection of the elastically deformable linkage during a portion of the deflection thereof.

In another aspect of the invention, a donor ribbon cartridge is provided. The donor ribbon cartridge comprises: a supply housing having a donor ribbon supply spool therein with a supply of unused donor ribbon wound on the supply spool; a take-up housing in parallel with the supply housing, the take-up housing having take-up spool therein, the supply housing and take-up housing having openings to allow donor ribbon to pass from the supply spool to the take-up spool; a stiffening linkage linking one end of the supply housing to an adjacent end of the take-up housing, the stiffening linkage capable of being resiliently deflected in to absorb a portion of an energy from an impact load, the deflection allowing the opposite ends of the supply housing and take-up housing to move between a range of positions relative to each other; and a shock absorber and spring linking the opposite ends of the supply housing and take-up housing the spring deflecting to absorb another portion of the energy from the impact load, and the shock absorber damping the deflection of the spring to absorb still another portion of the energy from the impact load.

In still another aspect of the invention, a thermal printer cartridge is provided. The thermal printer cartridge comprises: a supply housing having a supply spool with unused donor ribbon wound thereon and an opening through which donor ribbon can travel to a take-up spool; a take-up housing having the take-up spool therein and an opening to permit the donor ribbon to enter the housing; a first linkage for holding a first end of the supply housing and first end of the take-up housing within a first range of separation relative to each other, the first linkage being elastically deflectable to permit movement with the first range of separation and to absorb one portion of an energy from an impact load during the elastic deflection; a second linkage for holding a second end of the supply housing and second end of the take-up housing within a second range of separations relative to each other, the second linkage being elastically deflectable to permit variation of the separation within the second range of separation and to absorb another portion of the energy from a impact load during the elastic deflection; the second range of separation being larger than the first range of separation; and a linkage at the second end of the supply housing and the second end of the take-up housing for holding a second end of the supply housing and second end of the take-up housing within the second range of separations relative to each other, the third linkage being elastically deflectable in a manner that is different from the manner of deflection of the second linkage to that dampens the second linkage and absorb still another portion of the energy from an impact load.

DETAILED DESCRIPTION OF THE INVENTION

Figure 1:
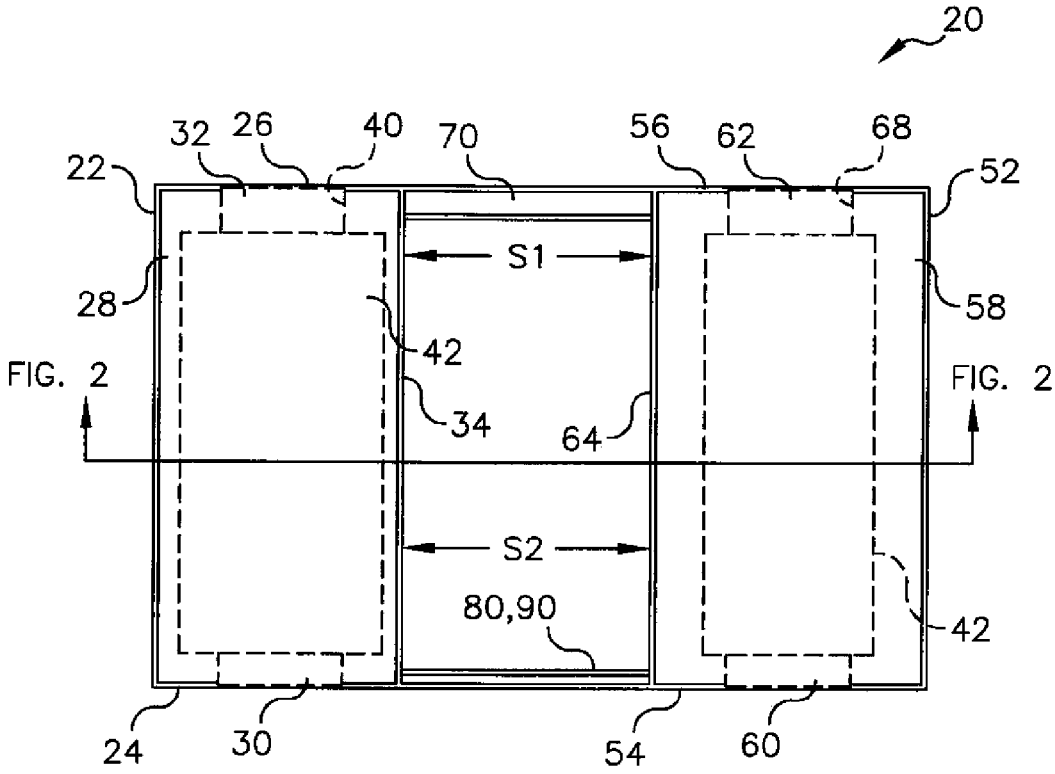
FIG. 1 illustrates a top view of one embodiment of the cartridge of the invention.
Figure 2:
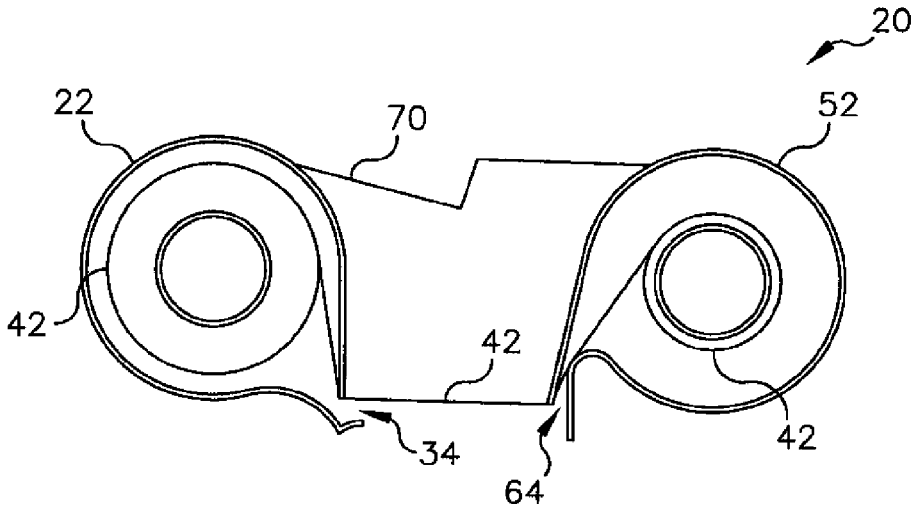
FIG. 2 illustrates a section view of the embodiment of FIG. 1.
Figure 3:
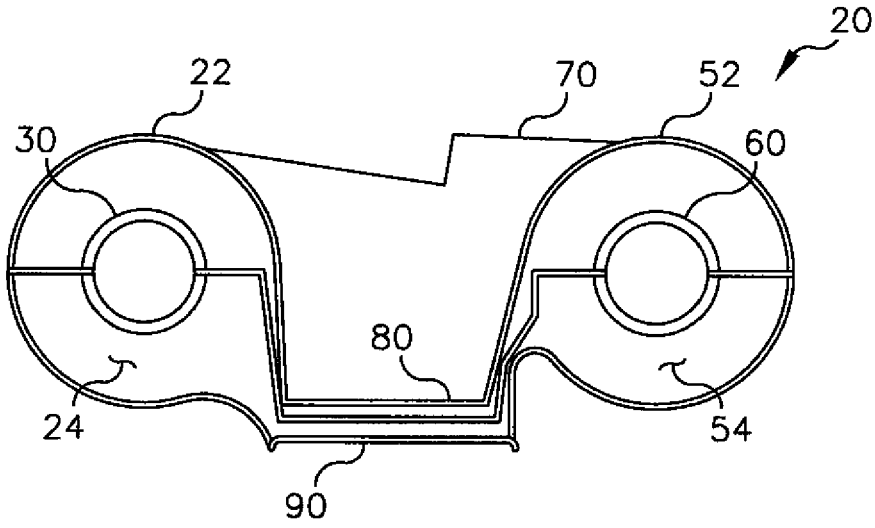
FIG. 3 illustrates an end view of the embodiment of FIG. 1.

FIGS. 1, 2 and 3 illustrate respectively a top, section and drive end side view of one embodiment of a thermal printer cartridge 20. As is illustrated in FIG. 1, in this embodiment, thermal printer cartridge 20 has a supply housing 22 with a drive end 24 and a non-drive end 26. Supply housing 22 defines a supply area 28 and defines bearing surfaces 30 and 32 adapted to receive a supply spool 40 having a supply of donor ribbon 42 thereon. An opening 34 in supply housing 22 permits donor ribbon 42 to pass out of supply housing 22.

Thermal printer cartridge 20 also has a take-up housing 52 with a drive end 54 and a non-drive end 56. Take-up housing 52 defines a take-up area 58 and bearing surfaces 60 and 62 that are adapted to receive a take-up spool 68 that is connected to donor ribbon 42. As is illustrated in FIG. 1, take-up housing 52 provides a take-up opening 64 through which donor ribbon 42 passes.

The supply housing 22 and take-up housing 52 are joined at the ends thereof by elastically deflectable linkages. These elastically deflectable linkages include a stiffening linkage 70, an elastically deformable linkage 80 and a damping linkage 90. In the embodiment of FIG. 1, stiffening linkage 70 joins non-drive end 26 of supply housing 22 to non-drive end 56 of take-up housing 52 and extends for a distance to define a lateral separation S1 between supply housing 22 and take-up housing 52. As will be discussed in greater detail below, stiffening linkage 70 is elastically deflectable to allow some degree of variation in separation S1 and to further allow some degree of variation in a separation S2 between drive ends 24 and 54. Such elastic deflection of stiffening linkage 70 absorbs one portion of the energy from an impact load.

Elastically deformable linkage 80 joins and defines drive end separation S2 between drive end 24 of supply housing 22 and drive end 54 of take-up housing 52. Elastically deformable linkage 80 is elastically deflectable in a manner to allow variation in the drive end separation S2. Such elastic deflection of elastically deformable linkage 80 absorbs another portion of the energy from an impact load.

Damping linkage 90 also joins drive end 24 of supply housing 22 to drive end 54 of take-up housing 52 and helps elastically deformable linkage 80 to define separation S2. Damping linkage 90 is defined in a manner so that damping linkage 90 elastically deforms in a different pattern than elastically deformable linkage 80. This difference in deflection patterns causes damping linkage 90 to act as a damper on the deflection of elastically deformable linkage 80.

Stiffening linkage 70 provides relatively stiffer beam strength than the combination of elastically deformable linkage 80 and damping linkage 90 provide. This relatively stiff connecting beam provides the majority of the structural integrity for thermal printer cartridge 20. Stiffening linkage 70, however, is not rigid along all axes, and can be elastically deformed to permit deformation of the deformable linkage 80 and/or damping linkage 90. This permits wide variations in drive end separation S2 as compared to the variations in first separation S1 which are limited by the relatively stiff beam strength of stiffening linkage 70. As noted above, a portion of the energy from an impact load can be absorbed in elastically deforming stiffening linkage 70.

It will be appreciated that a portion of the energy from an impact load applied to thermal printer cartridge 20 that is absorbed to induce deflection of stiffening linkage 70, deformable linkage 80 and/or damping linkage 90 will be dissipated in the form of heat and that a portion of the energy will be stored in the form of potential energy. Portions of the energy that are stored as potential energy are released as the impact energy begins to drop off. A decay cycle can then begin with stiffening linkage 70 acting effectively as a leaf spring, with deformable linkage 80 acting as would a compression spring and with damping linkage 90 acting as a shock absorber or damper on the action of either or both of stiffening linkage 70 and deformable linkage 80. As will be discussed in greater detail below, at some points in the decay cycle, portions of the potential energy will be held in a deflected stiffening linkage 70, with a portion this potential energy being released by stiffening linkage 70 in the form of kinetic energy that induces potential energy storing deflections at elastically deformable linkage 80 and damping linkage 90 and with a portion of the released potential energy being dissipated. At other times in the decay cycle, potential energy will be held in a deflected elastically deformable linkage 80 and damping linkage 90 with a portion of this potential energy being released to induce a deflection in stiffening linkage 70 and a portion of this released potential energy being dissipated. With each transfer of energy, a portion of the impact energy is dissipated until all of the impact energy is so dissipated.

Because at any given time, a portion of the energy from the impact load is held in the form of potential energy and because this potential energy is repeatedly transferred between different members over the time period required to dissipate the energy, thermal printer cartridge 20 can dissipate the energy from a impact load over a relatively long period of time and in a more controlled manner. This mitigates against causing non-elastic deformation any component of thermal printer cartridge 20.

FIGS. 4-8 illustrate one embodiment of a thermal printer cartridge 20 and a way in which this embodiment dissipates the energy applied by an impact load.

Figure 4:
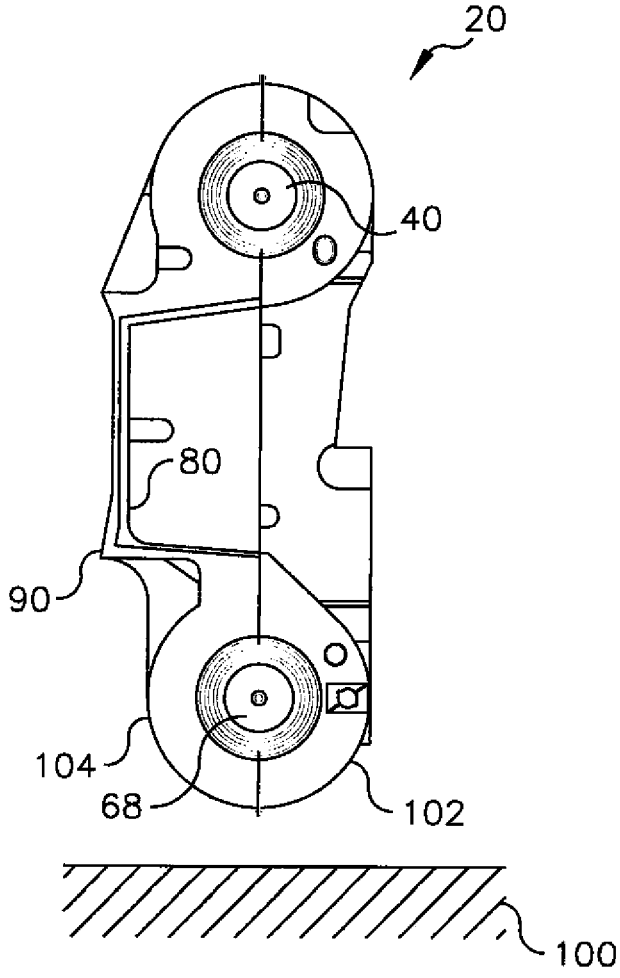
FIG. 4 illustrates one embodiment of a thermal printer cartridge during freefall toward a surface.

FIG. 4 shows thermal printer cartridge 20 in freefall heading toward an impact with an unforgiving surface 100. As is illustrated, in this embodiment, thermal printer cartridge 20 is formed from a two-piece shell assembly comprising an upper housing 102 and a lower housing 104 with the supply spool 40, donor ribbon (not illustrated) and take-up spool 68 therebetween. In this embodiment, therefore, elastically deformable linkage 80 and damping linkage 90 are each formed as separate components one being formed as a part that links portions of upper housing 102 and the other as a component that links portions of lower housing 104. It will be appreciated that, at this point deformable linkage 80 and damping linkage 90 are in contact.

Figure 5:
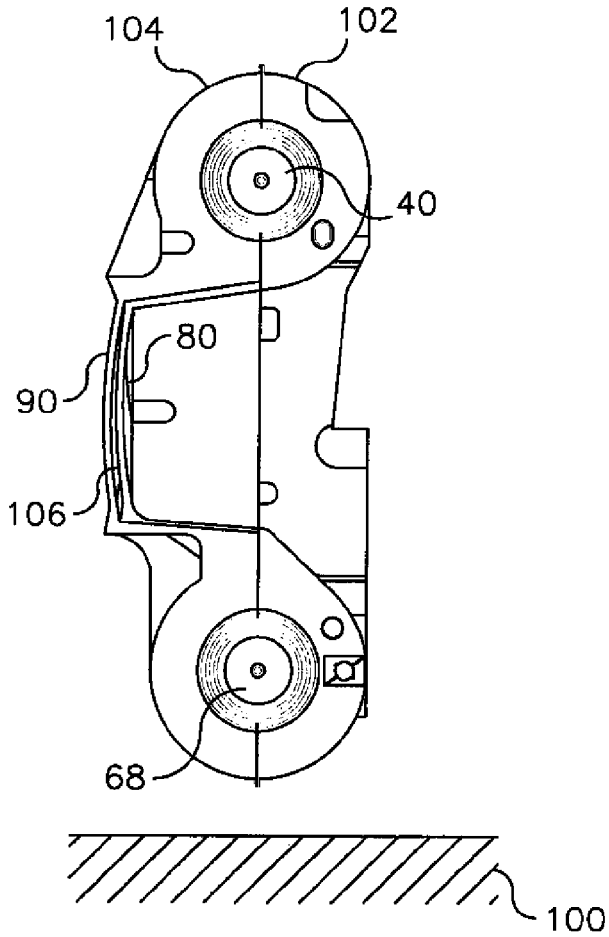
FIGS. 5 and 6 illustrate the thermal printer cartridge of FIG. 4 in impact with the surface.
Figure 6:
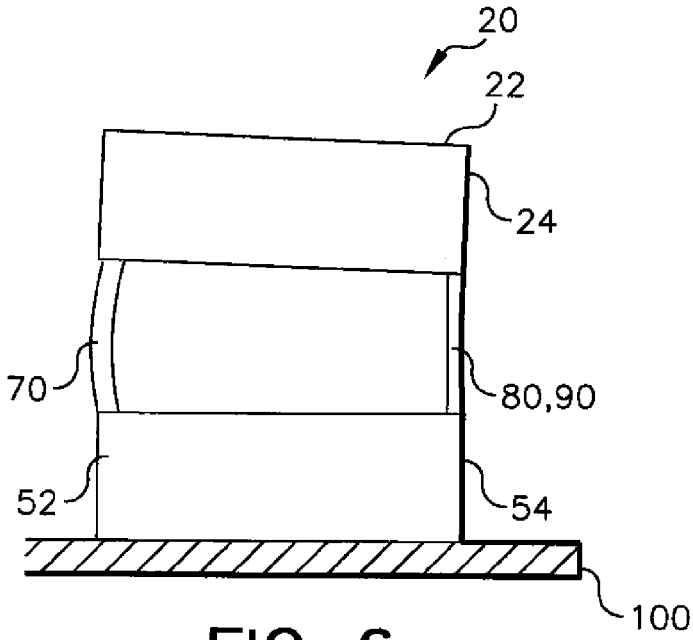

As is shown in FIGS. 5 and 6, upon impact, a portion of the energy from the impact load deflects stiffening linkage 70 and another portion causes elastically deformable linkage 80 and damping linkage 90 to deflect. This causes these links to slide apart which in turn causes deformable linkage 80 and damping linkage 90 to experience friction resisting such sliding. Such friction can dissipate part of the energy from the impact load.

Further, as shown in FIGS. 5 and 6, during impact, deformable linkage 80 and damping linkage 90 both deflect using different patterns of deflection, thus creating a gap area 106 between these members. This difference in pattern is also intended to causes deformable linkage 80 to more rapidly adjust to applied energy than damping linkage 90. Accordingly, as deformable linkage 80 and damping linkage 90 are joined between the same structures, the more restrained reaction of damping linkage 90 effectively acts as damper or shock absorber on deformable linkage 80. During impact, potential energy is stored in the elastically deformable linkage 80 and damping linkage 90.

Figure 7:
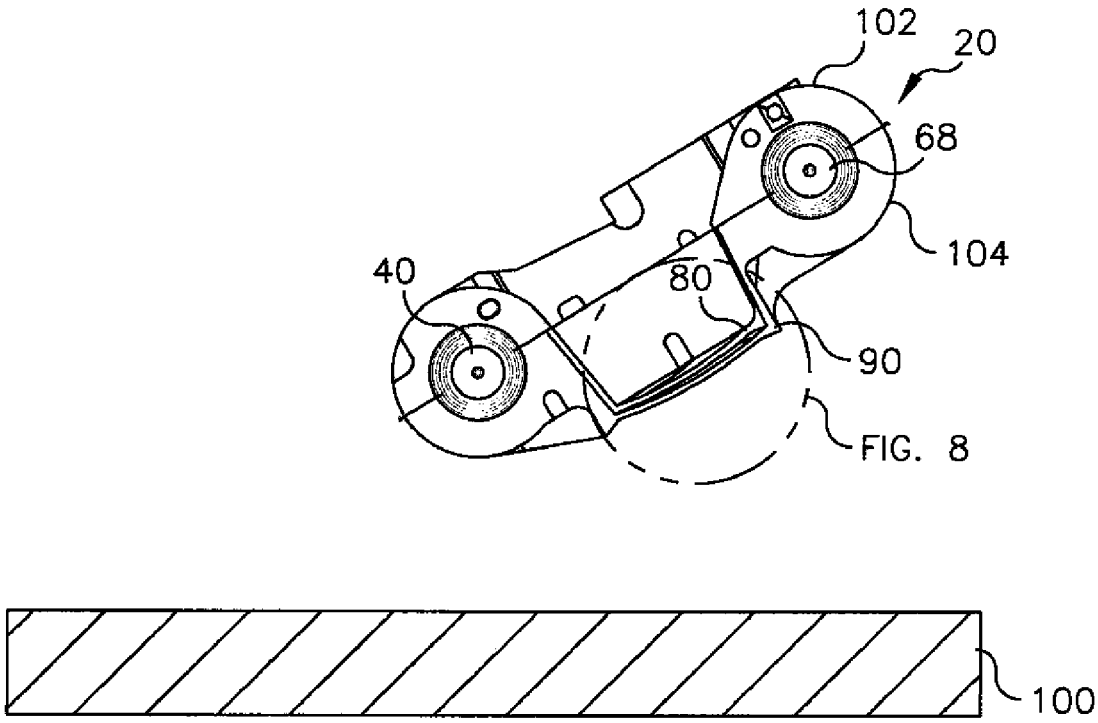
FIGS. 7 and 8 illustrate the thermal printer cartridge of FIG. 4 after impact with the surface.
Figure 8:
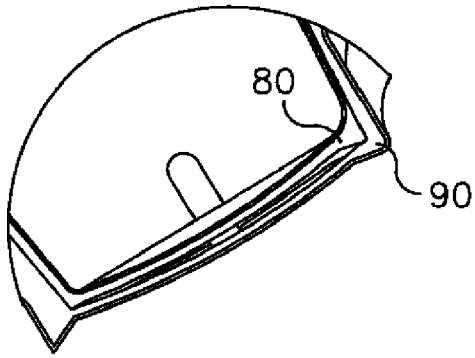

FIGS. 7 and 8 illustrate thermal printer cartridge 20 after the impact load is removed. Specifically, FIG. 7 illustrates that after the impact load is removed, stiffening linkage 70, deformable linkage 80 and damping linkage 90 release potential energy stored therein urging printer cartridge 20 to return toward an initial state initiating the decay cycle described above to dissipating energy from the impact load.

The invention has been described in detail with particular reference to certain preferred embodiments thereof, but it will be understood that variations and modifications can be effected within the spirit and scope of the invention.

PARTS LIST

20 thermal printer cartridge
22 supply housing
24 drive end
26 non-drive end
28 supply area
30 bearing surface
32 bearing surface
34 opening
40 supply spool
42 donor ribbon
52 take-up housing
54 drive end
56 non-drive end
58 take-up area
60 bearing surface
62 bearing surface
64 take-up opening
68 take-up spool
70 stiffening linkage
80 deformable linkage
90 damping linkage
100 surface
102 upper housing
104 lower housing
106 gap area
S1 separation
S2 separation

The invention claimed is:

1. A thermal printer cartridge comprising:

supply housing having a drive end and a non-drive end;

take-up housing having a drive end and a non-drive end;

a stiffening linkage joining the non-drive end of the supply housing to the non-drive end of the take-up housing to define a separation between them, said stiffening linkage having a first beam strength and being capable of elastic deflection to absorb one portion of an energy from an impact load;

an elastically deformable linkage joining the drive end of the supply housing to the drive end of the take-up housing, said elastically deformable linkage having a second beam strength and being adapted to elastically deform from a first state following a first deflection pattern and to absorb another portion of the energy from an impact load during elastic deformation; and a damping linkage joining the drive end of the supply housing to the drive end of the take-up housing, said damping linkage having a third beam strength and being adapted to elastically deflect from the first state following a second deflection pattern that is different than the first deflection pattern and to absorb a further portion of the amount of energy from the impact load during said deflection, said damping linkage further being adapted to damp deformation of the elastically deformable linkage during a portion of the deflection thereof, wherein at said first state said elastically deformable linkage and said damping linkage are in contact with each other, and at said impact load said first deflection pattern of said elastically deformable linkage and said second deflection pattern of said damping linkage cause a gap to be created between said elastically deformable linkage and said damping linkage, and wherein the first beam strength of said stiffening linkage is stiffer than the combination of the second beam strength of said elastically deformable linkage and the third beam strength of the damping linkage

2. The thermal printer cartridge of claim 1, wherein said elastically deformable linkage and said damping linkage elastically deflect along different deflection patterns to induce a friction therebetween to absorb a further portion of the energy from the impact load.

3. The thermal printer cartridge of claim 1, wherein said stiffening member, resilient linkage and damping linkage are adapted to store a portion of the energy absorbed thereby in the form of potential energy when deflected and to release portion of the potential energy by relaxing from the deflected position and to dissipate a portion of the absorbed potential energy during the process of being moved into a deflected position and during the process of relaxing from the deflected position.

4. The thermal printer cartridge of claim 1, wherein said supply housing, take-up housing, elastically deformable linkage and semi-rigid linkage are formed by joining two half-structural members using a pattern of integral fasteners.

* * * * *